United States Patent [19]

McLean et al.

[11] Patent Number: 4,887,972

[45] Date of Patent: Dec. 19, 1989

[54] SNAP-TOGETHER ENCLOSURE FOR A TELEPHONE JACK RECEPTACLE

[75] Inventors: Kenneth W. McLean, London; Gerd Kuhfus, Dorchester; Charles R. S. Walker, London, all of Canada

[73] Assignee: Northern Telecom Limited, Montreal, Canada

[21] Appl. No.: 296,648

[22] Filed: Jan. 12, 1989

[51] Int. Cl.[4] ..... H01R 13/44

[52] U.S. Cl. ..... 439/137; 439/140; 439/536; 439/676; 439/893

[58] Field of Search ..... 439/136–140, 439/142, 143, 145, 367, 536, 676, 893

[56] References Cited

U.S. PATENT DOCUMENTS

| | | | |
|---|---|---|---|
| 4,451,106 | 5/1984 | Wiseheart et al. | 339/123 |
| 4,494,815 | 1/1985 | Brzostek et al. | 339/123 |
| 4,624,516 | 11/1986 | White | 439/140 |
| 4,713,016 | 12/1987 | Kato | 439/137 |
| 4,729,741 | 3/1988 | Peng | 439/137 |
| 4,768,965 | 9/1988 | Chang | 439/137 |
| 4,778,398 | 10/1988 | Ahrani | 439/145 |
| 4,790,769 | 12/1988 | Kanada | 439/676 |

*Primary Examiner*—P. Austin Bradley

*Attorney, Agent, or Firm*—John E. Mowle; Robert C. Hogeboom

[57] ABSTRACT

A snap-together enclosure comprises a cover, a shutter mechanism, and a base plate. The enclosure is designed to encase a jack receptacle body which is heat staked to a terminal block. The shutter mechanism is snapped into a hole in the cover and is held in place by means of tabs on the shutter and interfering ridges on the cover. The terminal block is snapped into the base plate by means of tabs on the base plate and interfering ridges on the terminal block. Finally, the cover is snapped onto the base plate, again by use of tabs and interfering ridges on the cover and base plate respectively. When the cover and shutter assembly is attached to the base plate, the jack receptacle body, enclosed therein, pushes against back walls of the tabs on the shutter to prevent the shutter from disengaging with the ridges on the cover. The cover further holds the terminal block in position by integral ribs within the cover pressing against back walls of tabs on the base plate, thereby preventing the terminal block from disengaging from the base plate.

24 Claims, 10 Drawing Sheets

SNAP-TOGETHER ENCLOSURE FOR A TELEPHONE JACK RECEPTACLE

FIELD OF THE INVENTION

This invention relates generally to snap-together enclosures. More specifically this invention relates to snap-together enclosures for a telecommunications jack assembly.

BACKGROUND OF THE INVENTION

Telecommunication jacks are generally well known. By and large the telecommunication jacks of the past have been manufactured to standards required for analogue communications. This has allowed for communications paths which may withstand breaks in transmission of up to 100 milliseconds. However, since the world is changing from analogue to digital communications, a considerably higher quality jack is essential. In the digital world, a break in communications of even 1 millisecond could produce an erroneous signal to, for example, a telephone switching system thereby producing undesired results. It is thus imperative to have a more reliable telecommunications connection.

Snap-together jack assemblies are also known in the prior art. Examples of such may be found in U.S. Pat. No. 4,494,815 entitled "Self-Aligning Cover for Modular Tricoupler", issued Jan. 22, 1985 in the name of Brzostek et al., and U.S. Pat. No. 4,451,106 entitled "Snap In Communications Jack and Cover Plate Assembly", issued May 29, 1984 in the name of Wiseheart et al.

Although it is believed that both of these devices work well, existing telecommunication jacks have been susceptible to corrosion by ingested contaminants from outside sources. The existing jacks have generally been manufactured with no protection against outside contaminants being provided. Furthermore, jack assemblies to date have not had any added means to prevent a snap-fitted assembly from accidentally disengaging.

SUMMARY OF THE INVENTION

The present invention is directed to providing solutions to the above mentioned problems of existing telecommunication jacks. Firstly, the enclosure of the present invention is designed to provide for the higher quality needs of digital communications. Secondly, the jack receptacle is completely encased by the enclosure which has a shutter to allow access to the jack receptacle while at the same time restricting the ingestion of contaminants. Finally, the enclosure of the present invention is designed such that snap-fitted components are further held in place b the positioning of components which aid in preventing tabs from disengaging with their respective mating ridges.

Stated in other terms, the present invention is a snap-together enclosure for a jack receptacle, the enclosure comprising: a shutter having a front surface and a back surface, the shutter further having distally spaced elastically deformable elongate members extending from the back surface, each of the elongate members having a tab distally located from the back surface of the shutter; a cover having a front face, a back surface, and opposing parallel side walls, the front face having at least one opening defining interfering ridges, the shutter being inserted through the at least one opening by elastically deforming the elongate members which snap back to their original shape after the tabs pass interfering ridges in side walls of the at least one opening, wherein the tabs and the interfering ridges interact to prevent the shutter from being removed from the cover, the shutter being slidable within the at least one opening; a base plate having a front face and opposing parallel side walls, the side walls having interfering ridges therein which interact with tabs on the side walls of the cover to fixedly attach the cover to the base plate.

BRIEF DESCRIPTION OF THE DRAWINGS

The invention will be readily understood by the following description of a preferred embodiment, by way of example, in conjunction with the accompanying diagrammatic drawings, in which.

DETAILED DESCRIPTION OF THE INVENTION

Figure 1:
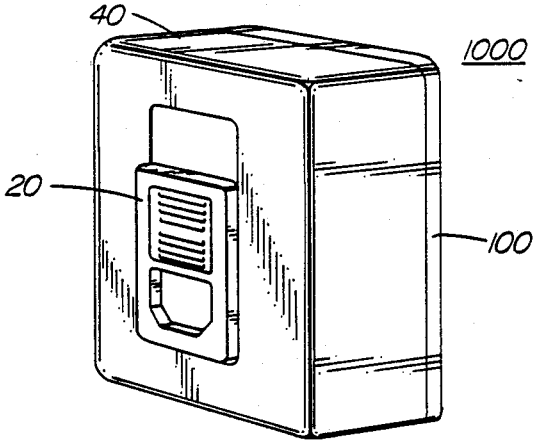
FIG. 1 is a perspective view of the enclosure of the present invention.

The enclosure 1000 of the present invention is depicted in FIG. 1 in a perspective view. From this view may be seen the base plate 100, the cover 40, and the free sliding shutter 20. Within the enclosure 1000 is a jack body 60 (not shown, and which may also be termed a jack receptacle) which is heat staked to a terminal block 80 (also not shown). In the following, a detailed description of the jack body 60 and the terminal block 80 will not be given as this information may be obtained from copending U.S. patent application Ser. No. 250,678 in the name of K. W. McLean et al., filed Sept. 29, 1988, and assigned to the same assignee as is the present invention.

Figure 2:
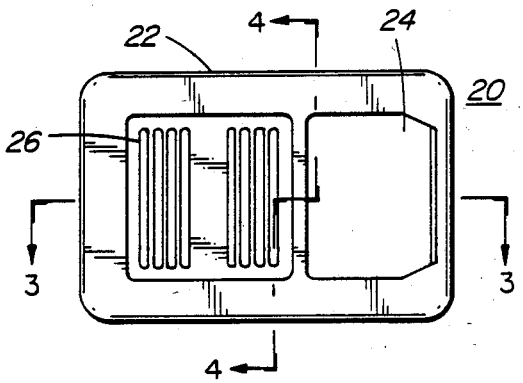
FIG. 2 is a top plan view of a shutter used on the enclosure of the present invention.

FIG. 2 shows a top plan view of the shutter 20 which is manufactured from a dielectric material (e.g. acrylonitrile butadene styrene (ABS), polycarbonate, or polyphenylene oxide). The shutter 20 comprises a body 22 in which an opening 24 is provided to allow access to the jack body 60 once it is encapsulated in the enclosure 1000. Next to the opening 24 is a series of ridges 26 which form a "finger grip" to assist a person in moving the shutter from a closed position to an open position. In normal use, the shutter 20 is self closing by means of gravity. To facilitate the shutter's 20 closing, a captive weight of a suitable material (such as stainless steel or lead) may be encased within the body 22 to provide additional weight to the shutter 20, thereby aiding in overcoming any frictional forces. Furthermore, the shutter 20 can be provided with a space wherein a company's logo may be brandlined onto the shutter, thereby allowing personalization of the enclosure 1000.

Figure 3:
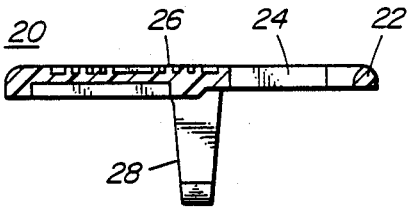
FIG. 3 is a cross-sectional view of the shutter of FIG. 2 taken along the section lines 3—3.
Figure 4:
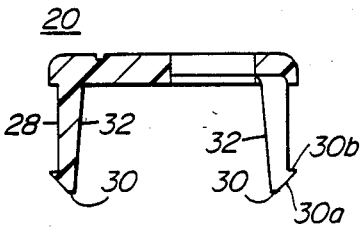
FIG. 4 is a cross-sectional view of the shutter of FIG. 2 taken along the section lines 4—4.

FIG. 3 illustrates the shutter 20 in crosssection as seen along section lines 3—3 of FIG. 2. This view better illustrates the ridges 26. This view further shows one of two elastically deformable elongate members 28 having back walls 32 (as seen in FIG. 4). At the ends of the elongate members 28, distal to the body 22 of the shutter 20, are tabs 30 (FIG. 4). The tabs 30 are used to attach the shutter 20 to the cover 40 (FIGS. 5 to 9) of the enclosure 1000. Each of the tabs 30 has an angled portion **30*a* which is used to deflect the elongate member 28 around the edges of an opening 44 in the cover 40. When each of the tabs 30 pass an interfering ridge 50 on the cover 40, the elongate members 28 snap back to their original form. Flat portions 30*b* then rest against the corresponding interfering ridges 50 and prevent the shutter 20 from being detached from the cover 40**.

Figure 5:
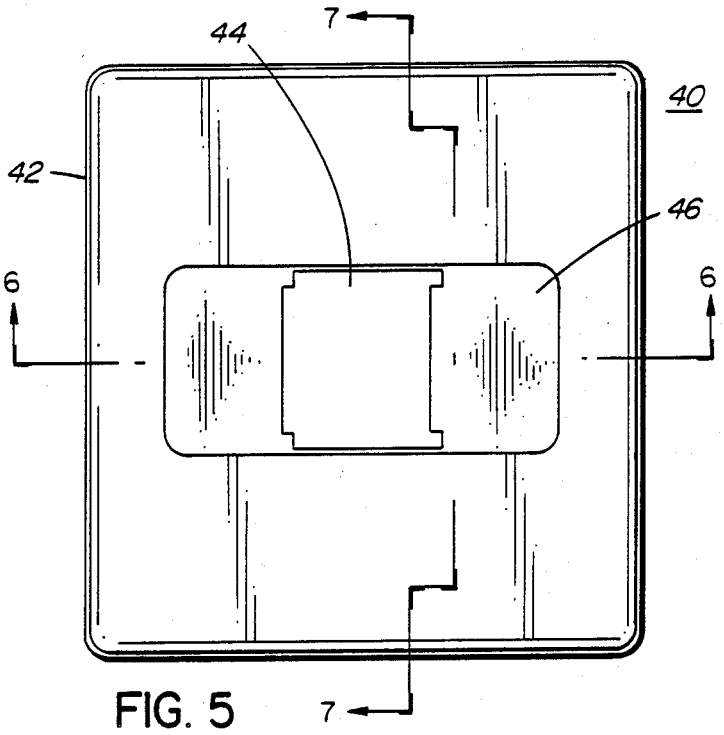
FIG. 5 is a top plan view of the cover of the present invention.

FIG. 5 shows a top plan view of the cover 40 of the enclosure 1000. Cover 40 comprises a dielectric body 42 (e.g. acrylonitrile butadene styrene (ABS), polycarbonate, or polyphenylene oxide) which has therein a shallow channel 46 in which the shutter 20 freely slides. Within the channel 46 is an opening 44 through which access to the jack body 60 may be obtained.

Figure 6:
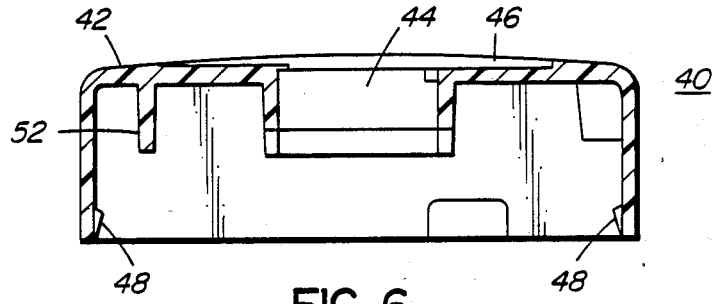
FIG. 6 is a cross-sectional view of the cover of FIG. 5 taken along the section lines 6—6.

FIG. 6 illustrates the cover 40 in cross-section as seen along section lines 6—6 in FIG. 5. FIG. 6 further shows two of four tabs 48 which are used to attach the cover 40 to the base plate 100. FIG. 6 also shows elongate member 52 which is used to maintain the terminal block 80 in position once the enclosure is completely assembled.

Figure 7:
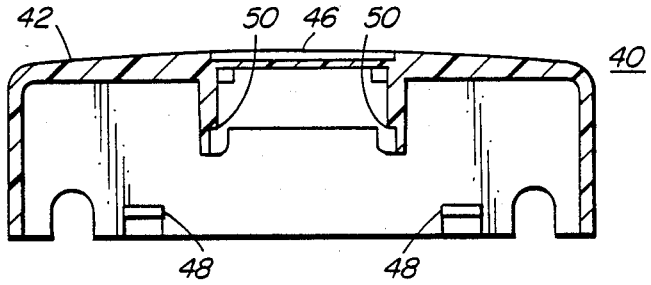
FIG. 7 is a cross-sectional view of the cover of FIG. 5 taken along the section lines 7—7.

FIG. 7 illustrates the cover 40 in cross-section as seen along section lines 7—7 in FIG. 5. The view depicted in FIG. 7 further illustrates the positioning of tabs 48 along the wall of the body 42. FIG. 7 also shows the interfering ridges 50 which, as mentioned above, are provided to interact with the tabs 30 of the elongate members 28 of the shutter 20.

Figure 8:
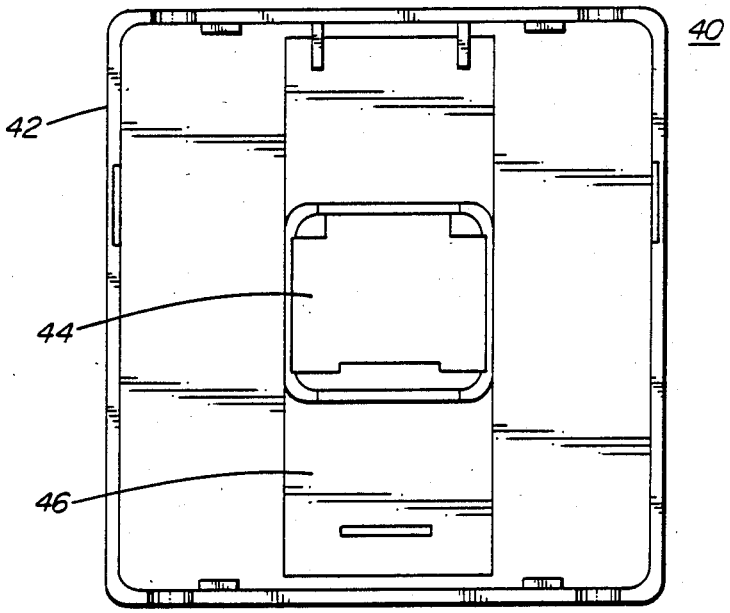
FIG. 8 is a bottom plan view of the cover of FIG. 5.

A bottom plan view of the cover 40 is illustrated in FIG. 8, further showing the features of the cover 40.

Figure 9:
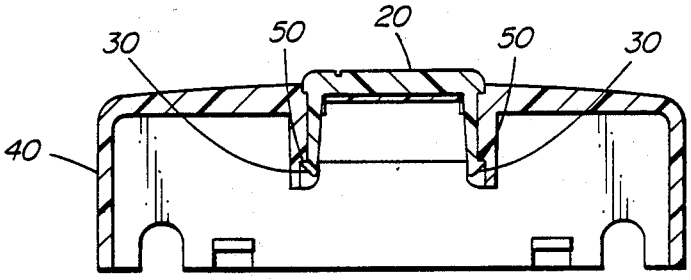
FIG. 9 is a cross-sectional illustrative view of the cover and shutter after mating of the parts.

FIG. 9 illustrates in cross-section the interaction of the shutter 20 with the cover 40. It can be readily viewed in this Figure how the tabs 30 of the shutter 20 mate with the corresponding interfering ridges 50 of the cover 40. In this manner, the interfering ridges 50 prevent the shutter 20 from being removed once the shutter 20 is inserted in the opening 44.

Figure 10:
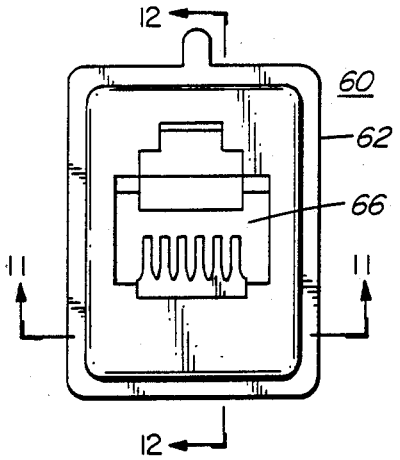
FIG. 10 is a top plan view of a jack body.
Figure 11:
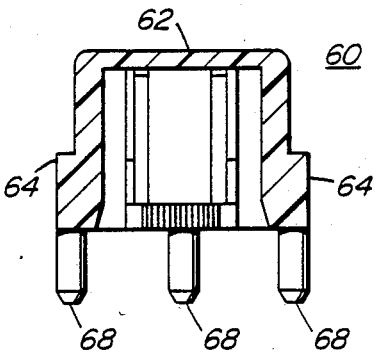
FIG. 11 is a cross-sectional view of the jack body of FIG. 10 taken along the section lines 11—11.
Figure 12:
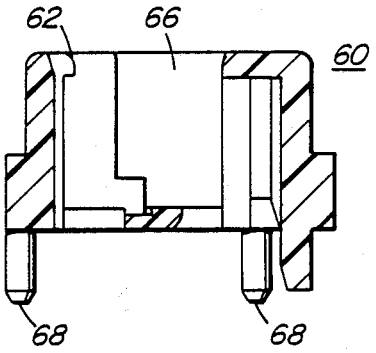
FIG. 12 is a cross-sectional view of the jack body of FIG. 10 taken along the section lines 12—12.

FIG. 10 is a top plan view of the jack body 60 which is encased by the enclosure 1000. The jack body 60 comprises a dielectric body 62 having therein a telecommunications plug receiving cavity 66. The body 62 has side portions 64 (as shown in FIG. 11) which, when the enclosure is put together, are in alignment with back walls 32 of the elongate members 28 of the shutter 20. The side portions 64 press against the back walls 32 thereby maintaining tabs 30 in position and further prevent the shutter 20 from accidentally, or intentionally, becoming disengaged from the cover 40 of the enclosure 1000. FIGS. 11 and 12 further show the jack posts 68 which are used to position the jack body in the terminal block 80. The jack posts 68 are heat staked to hold the jack body 60 in position.

Figure 13:
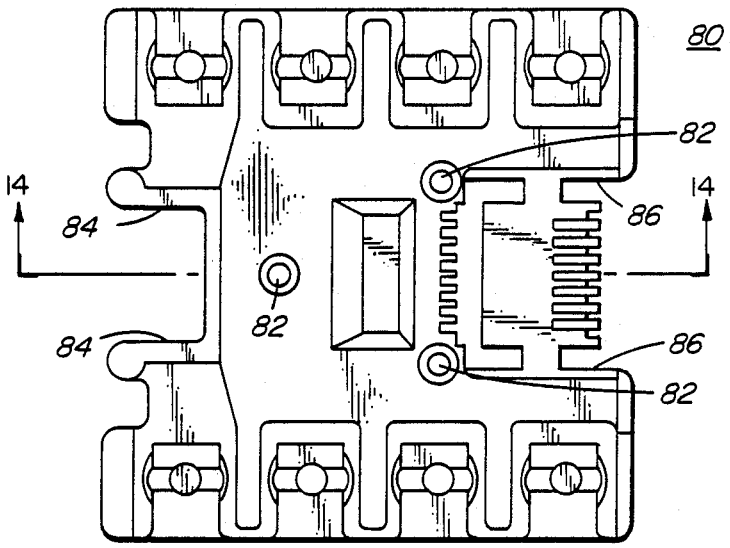
FIG. 13 is a top plan view of a terminal block.

FIG. 13 is a top plan view of the terminal block 80. Terminal block 80 is also manufactured from a dielectric material. Within the terminal block 80 are three jack post holes 82 which are provided to accept the jack posts 68 of the jack body 60. FIG. 13 also illustrates side members 84 and 86. The side members 84 and 86 are designed such that they act as interfering ridges for the tabs 102,106 on the base plate 100. Thus, in a similar manner to the shutter 20 and the cover 40, the terminal block 80 is fixedly attached to the base plate 100. As mentioned above, the terminal block 80 is further held in position by the elongated member 52 on the cover 40 which, when the enclosure 1000 is assembled, interacts with the tabs 102,106 thereby retaining the terminal block 80 in the base plate 100.

Figure 14:
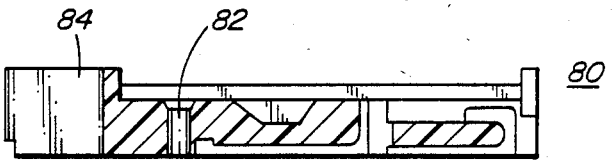
FIG. 14 is a cross-sectional view of the terminal block of FIG. 13 taken along the section lines 14–14.

FIG. 14 is a side cross-sectional view of the terminal block 80 as viewed along section lines 14—14 in FIG. 13. FIG. 14 further illustrates one of the jack post holes 82 and one of the side members 84.

Figure 15:
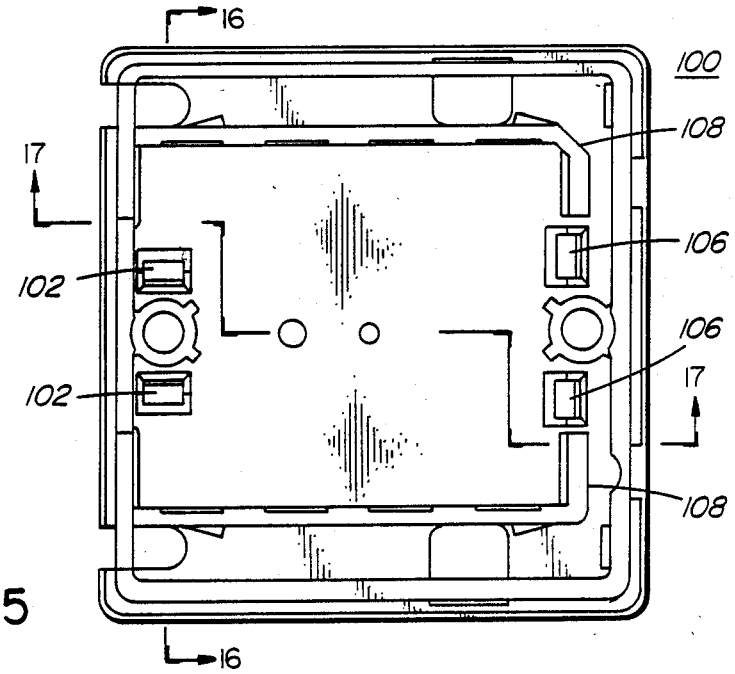
FIG. 15 is a top plan view of the base plate of the enclosure of the present invention.
Figure 16:
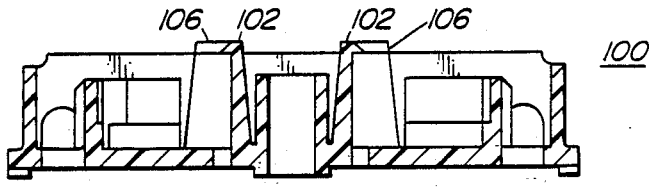
FIG. 16 is a cross-sectional view of the base plate of FIG. 15 taken along the section lines 16—16.
Figure 17:
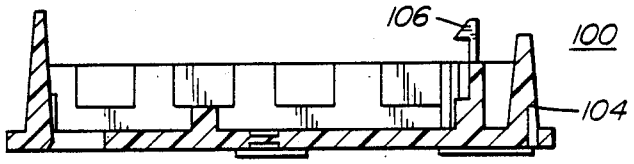
FIG. 17 is a cross-sectional view of the base plate of FIG. 15 taken along the section lines 17—17.

FIG. 15 is a top plan view of the dielectric base plate 100 FIG. 15 illustrates the positions of the tabs 102,106 used to hold the terminal block 80 in position. FIG. 16 further illustrates the orientation of the tabs 102,106, as does FIG. 17. To facilitate positioning of the terminal block 80, a frame 108 is integrally formed in the base plate 100 which precisely outlines the contour of the terminal block 80. Interfering ridges 104 (one of which is shown in FIG. 17) are provided to interact with the tabs 48 of the cover 40 to fixedly attach the cover 40 to the base plate 100.

Figure 18:
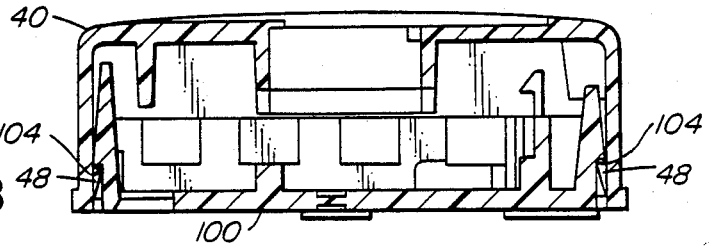
FIG. 18 is a cross-sectional elevational view of the cover and base plate after mating of the parts.

FIG. 18 illustrates in cross-section the interaction of the cover 40 with the base plate 100. It can be readily viewed in this Figure how the tabs 48 of the cover 40 mate with the corresponding interfering ridges 104 of the base plate 100. In this manner, the interfering ridges 104 prevent the cover 40 from being removed once the cover 40 is snapped onto the base plate 100.

Figure 19:
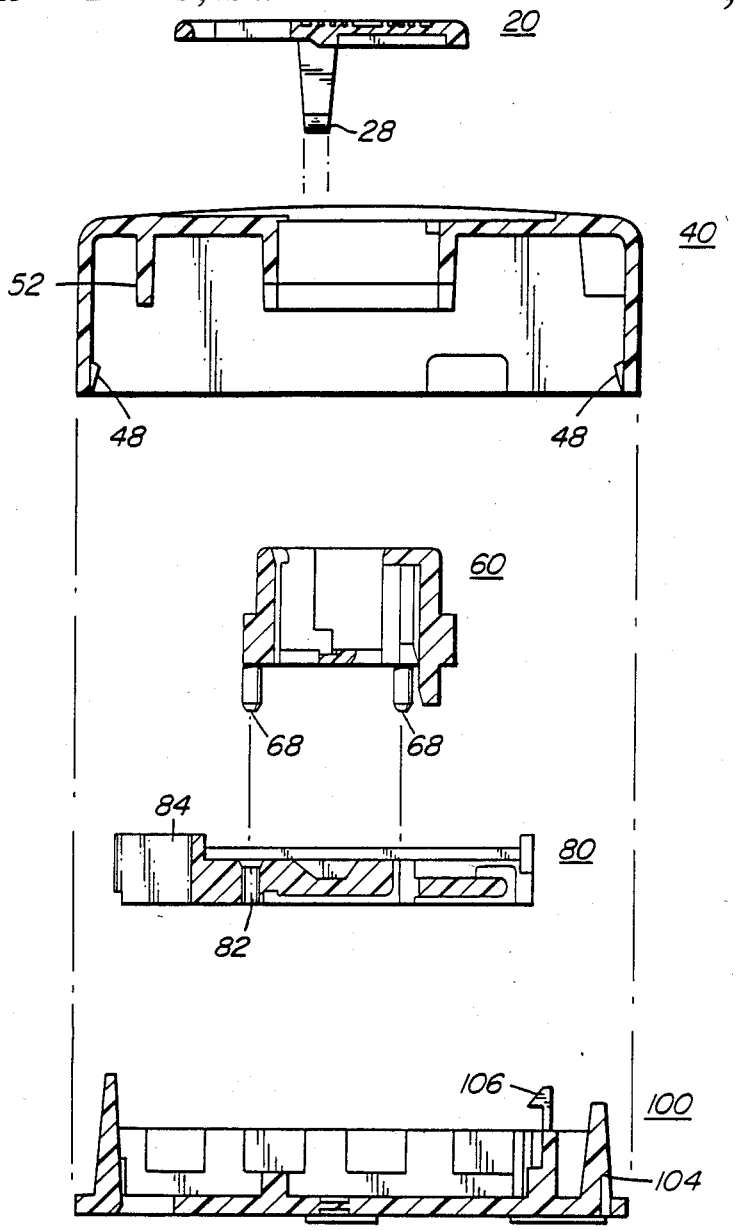
FIG. 19 is a cross-sectional exploded view of the enclosure of the present invention and the contents it encapsulates.
Figure 20:
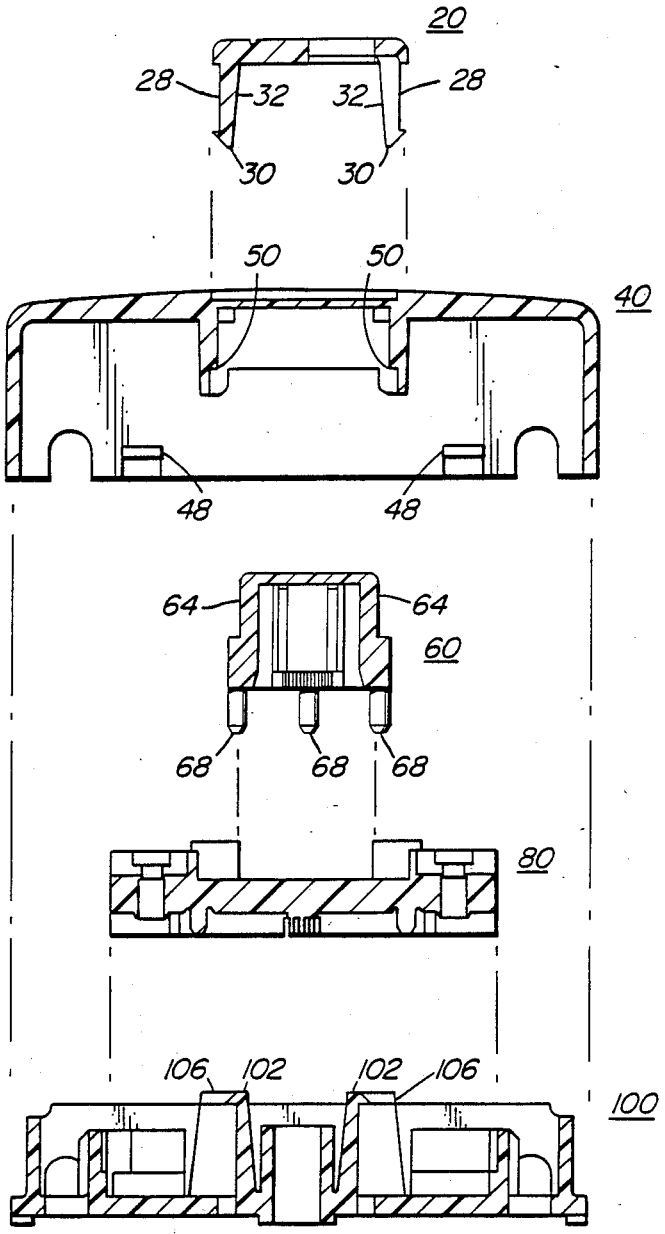
FIG. 20 is a further cross-sectional exploded view of the enclosure of the present invention.

FIGS. 19 and 20 are exploded cross-sectional views of the enclosure 1000 as viewed from adjacent sides respectively. From these Figures one can view the relative positions of each of the components.

Figure 21:
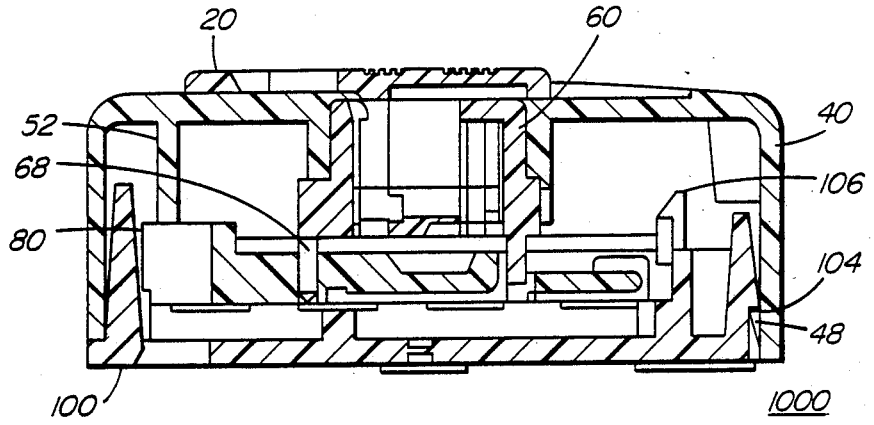
FIG. 21 is a cross-sectional view of the enclosure showing the inter-working of components of the enclosure of the present invention.

FIG. 21 is illustrative of the enclosure 1000 after assembly. In this view the relative positions of each of the components may be observed. This view also illustrates how the terminal block 80 is held in position by the tabs 106 of the base plate 100 and by the elongate member 52 of the cover 40. Furthermore, it can be observed how the tabs 48 of the cover 40 interact with the interfering ridges 104 of the base plate 100 to thereby hold the cover 40 and the base plate 100 together.

Figure 22:
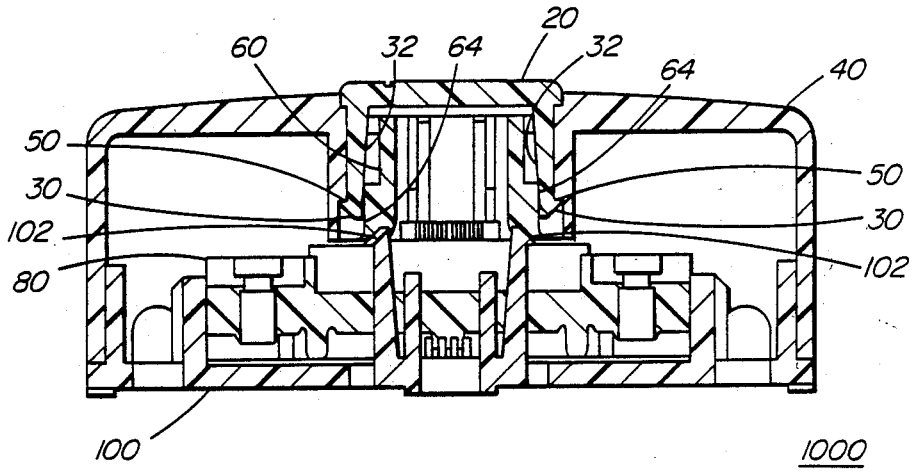
FIG. 22 is a further cross-sectional view, taken perpendicular to the view of FIG. 21, of the enclosure showing the inter-working of components of the enclosure.

FIG. 22 is a further view of the enclosure 1000 after assembly as viewed in a direction perpendicular to the view of FIG. 21. In this view it may be observed how the tabs 30 of the shutter 20 interact with the interfering ridges 50 of the cover 40 to thereby hold the shutter 20 in position. It may further be observed how the side portions 4 of the jack body 60 interact with the back walls 32 of the shutter 20 to maintain the tabs 30 in contact with the interfering ridges 50. Moreover, it may be observed how tabs 102 of base plate 100 maintain the terminal block 80 in position.

Figure 23:
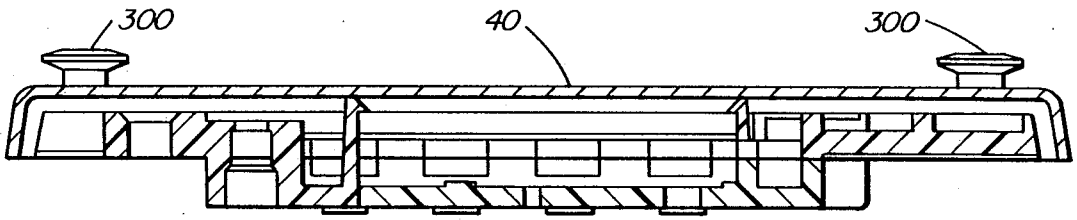
FIG. 23 is a cross-sectional view of an alternative embodiment of a cover, suitable for wall mount telephones.

FIG. 23 illustrates an alternative embodiment of the cover 40. As can be viewed in the Figure the cover 40 is conveniently adapted for use as a wall jack receptacle having studs 300 for supporting a wall mount telephone (not shown).

Figure 24:
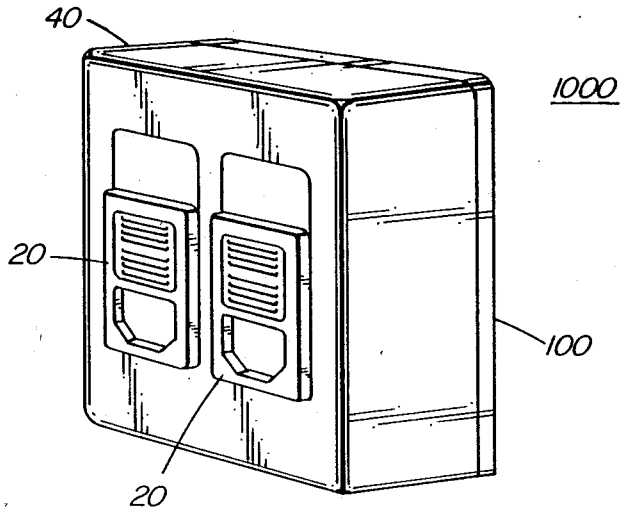
FIG. 24 is a perspective view of an alternative embodiment of the enclosure of the present invention.

It can be readily noted that the enclosure 1000 can be modified to encapsulate more than one jack receptacle. For instance an enclosure 1000 can easily be modified to encapsulate two jack receptacles, the enclosure 1000 having either two shutters 20 (as shown in FIG. 24), or having a modified shutter 20 which allows access to both jack receptacles.

In a preferred embodiment, the tabs 102,106 of the base plate 100 retain the terminal block 80, allowing a maximum of approximately 0.5 millimeters movement parallel to the base plate 100 in either direction and approximately 0.25 millimeters maximum movement perpendicular to the base plate 100. Furthermore, the shutter 20 slides freely in the cover 40, and falls freely to a closed position, thus completely covering the opening 44 in the cover 40, when the assembled enclosure is mounted up to approximately 10°, maximum, from the vertical in any direction. Moreover, the cover 40 can be disengaged from the base plate 100, without causing undue surface damage to the enclosure 1000, with a 6 millimeter wide screwdriver blade as the surfaces of the cover 40 or the base plate 100 are allowed to deform to a maximum of approximately 0.5 millimeters.

The snap-together enclosure herein described can be conveniently used as a baseboard jack receptacle enclosure; an electrical column jack receptacle enclosure; a wall jack receptacle enclosure; or a phone mount wall jack receptacle enclosure with minor modifications to the shape of the enclosure. Furthermore, the enclosure can be designed to enclose one jack receptacle, or a plurality of jack receptacles (as mentioned above).

Numerous other modifications, variations, and adaptations may be made to the particular embodiments of the invention described above without departing from the scope of the claims.

What is claimed is:

1. A snap-together enclosure for a jack receptacle, said enclosure comprising:

a shutter having a front surface and a back surface, said shutter further having distally spaced elastically deformable elongate members extending from said back surface, each of said elongate members having a tab distally located from said back surface of said shutter; and, a cover having a front face, a back surface, and opposing parallel side walls, said front face having at least one opening defining interfering ridges, said shutter being inserted through said at least one opening by elastically deforming said elongate members which snap back to their original shape after said tabs pass said interfering ridges, wherein said tabs and said interfering ridges interact to prevent said shutter from being removed from said cover, said shutter being slidable within said at least one opening; wherein a jack body encased in said enclosure has opposing parallel side walls, a plug receiving cavity and jack posts, said opposing parallel side walls interacting, after assembly of said enclosure, with back walls of said elongate members of said shutter to prevent said elongate members from elastically deforming, thereby preventing removal of said shutter from said cover.

2. The snap-together enclosure as claimed in claim 1 wherein said interfering ridges are elongate, extending from said back surface along at least two opposing sides of said at least one opening.

3. The snap-together enclosure as claimed in claim 1 further including a base plate having a front face and opposing parallel side walls, said side walls having interfering ridges therein which interact with tabs on said side walls of said cover to fixedly attach said cover to said base plate.

4. The snap-together enclosure as claimed in claim 3 wherein said base plate further has disposed thereon elastically deformable elongate members having tabs distally spaced from said front surface which interact with walls of a terminal block, encased within said enclosure to which said jack body is attached by heat staking, to fixedly attach said terminal block to said base plate.

5. The snap-together enclosure as claimed in claim 4 wherein said base plate and said terminal block, when joined together, are allowed a movement, one relative to the other, of approximately 0.5 millimeters maximum parallel to said base plate, and approximately 0.25 millimeters maximum perpendicular to said base plate.

6. The snap-together enclosure as claimed in claim 1, 3, or 4 wherein said shutter further includes a weight encapsulated in said shutter.

7. The snap-together enclosure as claimed in claim 1, 3 or 4 wherein said shutter slides freely within said at least one opening and falls to a closed position, solely by gravity, when said enclosure is mounted up to approximately 10° maximum from the vertical in any direction.

8. The snap-together enclosure as claimed in claim 4 wherein said cover further comprises an elongate member extending from said back surface which contacts said terminal block, upon assembly, and further maintains said terminal block in position with s id base plate.

9. The snap-together enclosure as claimed in claim 8 wherein said shutter further includes a weight encapsulated in said shutter.

10. The snap-together enclosure as claimed in claim 8 wherein said base plate and said terminal block, when joined together, are allowed a movement, one relative to the other, of approximately 0.5 millimeters maximum parallel to said base plate, and approximately 0.25 millimeters maximum perpendicular to said base plate.

11. The snap-together enclosure as claimed in claim 8 wherein said shutter slides freely within said at least one opening and falls to a closed position, solely by gravity, when said enclosure is mounted up to approximately 10° maximum from the vertical in any direction.

12. The snap-together enclosure as claimed in claim 3, 4 or 8 wherein the surfaces of said cover and said base plate can elastically deform approximately 0.5 millimeters maximum.

13. A snap-together enclosure for a jack receptacle, said enclosure comprising:

a plurality of shutters, each of said shutters having a front surface and a back surface and distally spaced elastically deformable elongate members extending from said back surface, each of said elongate members having a tab distally located from said back surface; and a cover having a front face, a back surface, and opposing parallel side walls, said front face having a plurality of openings defining interfering ridges, said plurality of shutters being inserted through said plurality of openings, in a one to one relationship, by elastically deforming said elongate members which snap back to their original shape after said tabs pass said interfering ridges, wherein said tabs and said interfering ridges interact to prevent said plurality of shutters from being removed from said cover, said plurality of shutters being slidable within said at least one opening;

wherein a plurality of jack bodies are encased in said enclosure, each of said jack bodies having opposing parallel side walls, a plug receiving cavity and jack posts, said opposing parallel side walls interacting, after assembly of said enclosure, with back walls of said elongate members of said plurality of shutters, in a one to one relationship, to prevent said elongate members from elastically deforming, thereby preventing removal of said shutters from said cover.

14. The snap-together enclosure as claimed in claim 13 further including a base plate having a front face and opposing parallel side walls, said side walls having interfering ridges therein which interact with tabs on said side walls of said cover to fixedly attach said cover to said base plate.

15. The snap-together enclosure as claimed in claim 14 wherein said base plate further has disposed thereon elastically deformable elongate members having tabs distally spaced from said front surface which interact with walls of a terminal block, encased within said enclosure to which said plurality of jack bodies are attached by heat staking, to fixedly attach said terminal block to said base plate.

16. The snap-together enclosure as claimed in claim 13, 14 or 15 wherein each of said plurality of shutters further includes a weight encapsulated in said shutter.

17. The snap-together enclosure as claimed in claim 13, 14, or 15 wherein said plurality of shutters and said plurality of openings are two in number.

18. The snap-together enclosure as claimed in claim 13, 14, or 15 wherein said plurality of jack bodies is two.

19. The snap-together enclosure as claimed in claim 13, 14, or 15 wherein said interfering ridges are elongate, extending from said back surface along at least two opposing sides of each of said plurality of openings.

20. The snap-together enclosure as claimed in claim 13, 14 or 15 wherein said plurality of shutters slide freely within said plurality of openings and fall to a closed position, solely by gravity, when said enclosure is mounted up to approximately 10° maximum from the vertical in any direction.

21. The snap-together enclosure as claimed in claim 15 wherein said cover further comprises an elongate member extending from said back surface which contacts said terminal block, upon assembly, and further maintains said terminal block in position with said base plate.

22. The snap-together enclosure as claimed in claim 16 wherein each of said plurality of shutters further includes a weight encapsulated in said shutter.

23. The snap-together enclosure as claimed in claim 15 or 21 wherein said base plate and said terminal block, when joined together, are allowed a movement, one relative to the other, of approximately 0.5 millimeters maximum parallel to said base plate, and approximately 0.25 millimeters maximum perpendicular to said base plate.

24. The snap-together enclosure as claimed in claim 14, 15, or 21 wherein the surfaces of said cover and said base plate can elastically deform approximately 0.5 millimeters maximum.

* * * * *